US008523289B2

(12) United States Patent
Helsel et al.

(10) Patent No.: US 8,523,289 B2
(45) Date of Patent: Sep. 3, 2013

(54) RETENTION ASSEMBLY FOR CUTTING BIT

(75) Inventors: Eric P. Helsel, New Enterprise, PA (US); Stephen Stiffler, New Enterprise, PA (US); Donald Keller, Bedford, PA (US); Don Rowlett, Bedford, PA (US)

(73) Assignee: Kennametal Inc., Latrobe, PA (US)

( * ) Notice: Subject to any disclaimer, the term of this patent is extended or adjusted under 35 U.S.C. 154(b) by 567 days.

(21) Appl. No.: 12/755,759

(22) Filed: Apr. 7, 2010

(65) Prior Publication Data

US 2011/0089747 A1 Apr. 21, 2011

Related U.S. Application Data

(60) Provisional application No. 61/168,270, filed on Apr. 10, 2009.

(51) Int. Cl.
*E21C 35/193* (2006.01)

(52) U.S. Cl.
USPC ..... 299/102

(58) Field of Classification Search
USPC ..... 299/102–113
See application file for complete search history.

(56) References Cited

U.S. PATENT DOCUMENTS

| | | | | |
|---|---|---|---|---|
| 868,291 | A * | 10/1907 | Rawlins | 299/82.1 |
| 3,622,206 | A | 11/1971 | Krekeler | |
| 3,749,449 | A | 7/1973 | Krekeler | |
| 4,163,581 | A | 8/1979 | Krekeler | |
| 4,497,520 | A | 2/1985 | Ojanen | |
| 4,650,254 | A | 3/1987 | Wechner | |
| 4,955,264 | A | 9/1990 | Armbrust | |
| 5,067,775 | A | 11/1991 | D'Angelo | |
| 5,605,382 | A | 2/1997 | Massa | |
| 5,607,206 | A | 3/1997 | Siddle et al. | |
| 5,769,505 | A | 6/1998 | Siddle et al. | |
| 5,833,323 | A | 11/1998 | Massa et al. | |
| 6,129,422 | A | 10/2000 | Siddle et al. | |
| 6,220,671 | B1 | 4/2001 | Montgomery, Jr. | |

(Continued)

FOREIGN PATENT DOCUMENTS

GB 2111098 A * 6/1983

OTHER PUBLICATIONS

PCT US 10/30419 Notofication of Transmittal of the International Search Report and the Written Opinion Jun. 28, 2010 (2 pages).

(Continued)

*Primary Examiner* — Sunil Singh
(74) *Attorney, Agent, or Firm* — Matthew W. Smith, Esq.

(57) ABSTRACT

A cutting bit retention assembly (399) that includes a cutting bit holder (500), which receives a cutting bit (58) and has shank (504) that extends into a bore (418) in a support (400). The shank section (504) of the cutting bit holder (500) presents a surface (530) defined by a notch (528) that selectively cooperates with a retention pin (670). A transverse bore (430) in the support (400) carries the retention pin (670). The retention pin (670) is selectively movable to any one of several positions. One position is a non-retaining position wherein the retention pin (670) does not engage the notch surface (530). Another position is a retaining position in which the retention pin (670) engages the notch surface (530) to urge the cutting bit holder into the cutting bit holder bore (418). Still another position is an ejecting position in which the retention pin (670) engages the notch surface (530) to urge the cutting bit holder (500) out of the cutting bit holder bore (418).

3 Claims, 15 Drawing Sheets

(56) References Cited

U.S. PATENT DOCUMENTS

| | | | |
|---|---|---|---|
| 6,234,579 | B1 | 5/2001 | Montgomery, Jr. |
| 6,331,035 | B1 | 12/2001 | Montgomery, Jr. |
| 7,070,244 | B2 | 7/2006 | Fischer et al. |
| 7,144,192 | B2 | 12/2006 | Holl et al. |
| 7,370,916 | B2 | 5/2008 | Ley et al. |
| 7,380,887 | B2 | 6/2008 | Latham |
| 2006/0243840 | A1 | 11/2006 | Latham |

OTHER PUBLICATIONS

PCT US 10/30419 International Search Report Jun. 28, 2010 (2 pages).

PCT US 10/30419 Written Opinion of the International Searching Authority Jun. 28, 2010 (6 pages).

* cited by examiner

RETENTION ASSEMBLY FOR CUTTING BIT

CROSS-REFERENCE TO EARLIER PATENT APPLICATION

This patent application is a non-provisional patent application is based in part upon U.S. Provisional Patent Application Ser. No. 61/168,270 filed on Apr. 10, 2009 by Eric P. Helsel and Stephen P. Stiffler for a RETENTION ASSEMBLY FOR CUTTING BIT. Under the United States Patent Statute, applicants herein (Eric P. Helsel, Don Rowlett, Donald E. Keller and Stephen P. Stiffler) hereby claim the priority of said provisional patent application (U.S. Provisional Patent Application Ser. No. 61/168,270 filed on Apr. 10, 2009 by Helsel and Stiffler for a RETENTION ASSEMBLY FOR CUTTING BIT). Further, applicants hereby incorporate by reference herein the entirety of the above mentioned U.S. Provisional Patent Application Ser. No. 61/168,270 filed on Apr. 10, 2009 to Helsel and Stiffler.

BACKGROUND OF THE INVENTION

The invention relates to a retention assembly for a cutting bit. More particularly, the invention pertains to a retention assembly for retaining a cutting bit holder (or tool holder) in a support block (or base) during use wherein the cutting bit holder carries the cutting bit.

Mining machines and construction machines (e.g., a road planing machine or road milling machine) are useful in continuous mining or road milling applications to mine or mill earth strata such as, for example, coal, asphalt, concrete and the like. These mining machines and construction machines utilize cutting bit assemblies. Each cutting bit assemblies for continuous mining or road milling applications typically comprises a cutting bit rotatably mounted within a support block. In turn, the support block mounts, typically by welding, on a drum or other body, wherein a suitable power source (or means) drives the drum. When a number of such support blocks carrying cutting bits are mounted onto a drum, and the drum is driven, the cutting bits will impinge and break up the earth strata into many pieces (i.e., cutting debris). Skilled artisans know the general operation of such a mining machine or construction machine. U.S. Pat. No. 7,144,192 to Holl et al. for a SELF-PROPELLED ROAD MILLING MACHINE, U.S. Pat. No. 7,370,916 to Ley et al. for a REAR LOADER ROAD MILLING MACHINE WITH HEIGHT-ADJUSTABLE SEALING DEVICE, and U.S. Pat. No. 7,070,244 to Fischer et al. for a ROAD MILLING MACHINE are exemplary patent documents that disclose such mining machines and/or construction machines.

During operation of the mining or construction machine, the support block experiences wear due to exposure thereof to the cutting debris. Over time, wear and other kinds of abuse causes the support block to become ineffective which signals an end to its useful life. Once this occurs, the operator must cut or torch the support block off the drum to allow for replacement of the support block. Typically, the operator welds the replacement support block on the drum. As the skilled artisan appreciates, it is time-consuming, and hence costly, to remove and replace a support block. Thus, there is an advantage to be able to prolong the useful life of the support block.

To prolong the life of the support block, one may use a cutting bit holder, sometimes referred to as a cutting bit sleeve, wherein the cutting bit rotatably or otherwise releasably mounts within the cutting bit holder. The cutting bit holder mounts within the support block via a mechanical connection. The presence of the cutting bit holder helps protect the support block from abuse and wear, thus minimizing or eliminating the periods of down time otherwise required for drum repair. The skilled artisan is aware of the use of cutting bit holders.

The skilled artisan is aware that cutting bits and cutting bit holders are subjected to considerable stresses during mining operations, road milling operations or other like operations. Accordingly, there is a desire to mount the cutting bit holder in the support block to minimize movement of the cutting bit holder in order to maximize the useful life of the cutting bit. It is also important that the mounting between the cutting bit holder and the support block be resistant to vibratory loosening which could likewise lead to premature cutting bit wear and failure. Heretofore, various structures exist to mount a cutting bit sleeve within a support block in an attempt to minimize cutting bit holder movement or loosening, while maximizing cutting bit life.

A mining machine or a road milling machine operates typically in severe operating conditions. During operation, the cutting bit holder (or tool holder) and/or the support block (or base) can experience damage such that it is difficult to disassemble these components. It is an advantage to be able to disassemble the cutting bit holder from the support block. Thus, it would be highly desirable to provide a cutting bit holder-support block assembly that facilitates a relatively easy disassembly of the cutting bit holder from the support block. Further, during operation, the severe operating conditions can also cause the rotatable cutting bit to lodge in the bore of the cutting bit holder. It would be advantageous to disassemble the cutting bit from the cutting bit holder. Thus, it is highly desirable to provide a cutting bit-cutting bit holder assembly that facilitates the relatively easy disassembly of the cutting bit from the cutting bit holder.

The following patent documents are exemplary of these various structures: U.S. Pat. No. 5,067,775 to D'Angelo for RETAINER FOR ROTATABLE BITS; U.S. Pat. No. 6,129,422 to Siddle et al. for a CUTTING TOOL HOLDER RETENTION SYSTEM; U.S. Pat. No. 5,769,505 to Siddle et al. for a CUTTING TOOL HOLDER RETENTION SYSTEM; U.S. Pat. No. 6,220,671 to Montgomery, Jr. for a CUTTING TOOL HOLDER RETENTION SYSTEM; U.S. Pat. No. 6,234,579 to Montgomery, Jr. for a CUTTING TOOL HOLDER RETENTION SYSTEM; U.S. Pat. No. 6,331,035 to Montgomery, Jr. for a CUTTING TOOL HOLDER ASSEMBLY WITH PRESS FIT; U.S. Pat. No. 3,749,449 to Krekeler for a MEANS FOR REMOVABLY AFFIXING CUTTER BIT AND LUG ASSEMBLIES TO DRIVER ELEMENT OF A MINING MACHINE OR THE LIKE; U.S. Pat. No. 4,650,254 to Wechner for a BIT HOLDER; and U.S. Pat. No. 5,607,206 to Siddle et al. for a CUTTING TOOL HOLDER RETENTION SYSTEM.

SUMMARY OF THE INVENTION

In one form thereof, the invention is a cutting bit retention assembly that comprises a cutting bit holder, which has a leading end and a trailing end. The bit holder has a head section adjacent to the leading end and a shank section adjacent to the trailing end. The head section of the cutting bit holder contains a cutting bit bore adapted to receive the cutting bit. The shank section of the cutting bit holder contains a slot defined by a slot surface. There is a support block, which contains a cutting bit holder bore. The support block further contains a transverse bore wherein the transverse bore opens into the cutting bit holder bore. The cutting bit holder bore is adapted to receive the shank section of the cutting bit holder.

There is a retention pin, which is received within the transverse bore whereby the retention pin extends into the slot. The retention pin selectively is in a non-retaining position wherein the retention pin does not engage the slot surface or a retaining position in which the retention pin engages the slot surface to urge the cutting bit holder into the cutting bit holder bore or an ejecting position in which the retention pin engages the slot surface to urge the cutting bit holder out of the cutting bit holder bore.

In another form thereof, the invention is a cutting bit holder for use with a support block. The cutting bit holder comprises a cutting bit holder body that has a leading end and a trailing end. The cutting bit holder body has a head section adjacent to the leading end and a shank section adjacent to the trailing end. The shank section has a central longitudinal axis. The head section of the cutting bit holder contains a cutting bit bore adapted to receive the cutting bit. The cutting bit bore has a central longitudinal axis. The shank section of the cutting bit holder contains a slot defined by a slot surface. The slot surface includes a pair of spaced-apart generally planar side slot surfaces wherein the side slot surfaces being generally parallel to each other. The slot surface has an arcuate side slot surface joining together the generally planar side slot surfaces.

In yet another form thereof, the invention is a support block for use with a cutting bit holder. The support block comprises a support block body containing a cutting bit holder bore adapted to receive the shank section of the cutting bit holder that contains a slot defined by a slot surface. The support block further contains a transverse bore, and the transverse bore opens into the cutting bit holder bore. There is a retention pin threadedly received within the transverse bore and passing into the cutting bit holder bore. The retention pin selectively is in a non-retaining position and a retaining position and an ejecting position. When the retention pin is in the non-retaining position, the retention pin does not engage the slot surface. When the retention pin is in the retaining position, the retention pin engages the slot surface to urge the cutting bit holder into the cutting bit holder bore in the support block. When the retention pin is in the ejecting position, the retention pin engages the slot surface to urge the cutting bit holder out of the cutting bit holder bore in the support block.

In another form thereof, the invention is a camming pin for use in engaging or disengaging a cutting bit holder to a support block containing a slot defined by a slot surface. The camming pin comprises an elongate pin body having an attachment section wherein the camming pin attaches to the support block at the attachment section. The elongate pin body further has a camming section wherein the camming section engages the slot surface to either move the cutting bit holder into engagement with the support block or to move the cutting bit holder out of engagement with the support block.

In another form thereof, the invention is a cutting tool holder-base assembly that comprises a cutting tool holder, which has a head region containing a cutting tool bore. The cutting tool holder further contains a shank region that has a distal end and a notch defined by a notch surface at the distal end, The assembly further includes a base containing a tool holder bore and a transverse passage intersecting the tool holder bore. The assembly further comprises a camming pin received within the transverse passage, The camming pin presents a camming region in the tool holder bore. The camming region is movable to any one of a neutral position to facilitate complete insertion of the shank region into the bore of the base, a retention position wherein the camming region engages the notch surface to facilitate the engagement of the tool holder to the base, and a disengagement position wherein the camming region engages the notch surface to facilitate the disengagement of the tool holder from the base.

In yet another form thereof, the invention is a cutting tool holder for receipt in a bore of a base member having a threaded camming pin with a camming region in the bore. The cutting tool holder comprises a head region, which contains a cutting tool bore, and contains a shank region, which has a distal end. The shank region has a notch defined by a notch surface at the distal end thereof. The cutting tool holder further contains a positioning bore adapted to receive a positioning tool.

In still another form thereof, the invention is a base for use with a cutting tool holder wherein the base comprises a base body that contains a tool holder bore and a transverse passage intersecting the tool holder bore. There is a camming pin received within the transverse passage wherein the camming pin presents a camming region in the tool holder bore. The camming region is movable to any one of a neutral position to facilitate complete insertion of the shank region into the bore of the base, a retention position wherein the camming region engages the notch surface to facilitate the engagement of the tool holder to the base, and a disengagement position wherein the camming region engages the notch surface to facilitate the disengagement of the tool holder from the base.

BRIEF DESCRIPTION OF THE DRAWINGS

The following is a brief description of the drawings.

DETAILED DESCRIPTION

Figure 1:
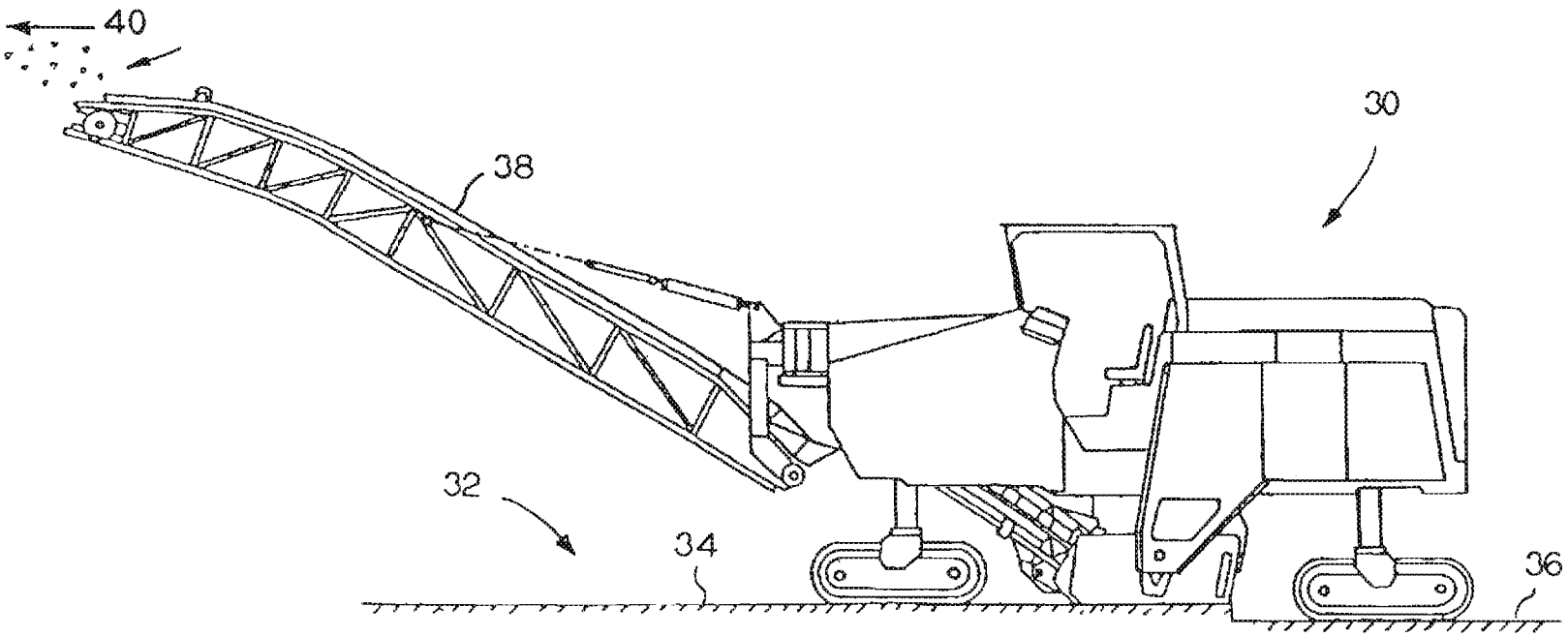
FIG. 1 a side view of a road milling machine in operation showing a milled surface of the roadway and an unmilled surface of the roadway along with debris exiting the conveyor of the road milling machine.

Referring to the drawings, FIG. 1 shows a road milling machine generally designated as 30. Road milling machine 30 travels over a roadway generally designated as 32 wherein the roadway 32 exhibits an unmilled roadway 34 and a milling roadway 36. FIG. 1 illustrates the milled roadway 36 as having a top layer removed to be lower than the unmilled roadway 34.

As the skilled artisan appreciates, the road milling machine 30 contains a rotatable road milling drum 44. Road milling drum 44 presents a cylindrical surface 46. A plurality of support blocks (described hereinafter) mount such as, for example, by welding of the cylindrical surface 46. As will be described hereinafter for a specific embodiment of the inventive cutting bit assembly, each support block retains a cutting bit holder, and the cutting bit holder retains a cutting bit. The inventive cutting bit retention assembly comprises the support block and the cutting bit holder. When a number of such cutting bit retention assemblies carrying cutting bits (i.e., cutting bit assemblies) mount to a drum, and the drum is driven, the cutting bits impinge and break up the earth strata (e.g., asphaltic roadway material, concrete, coal, and the like) into many pieces (i.e., cutting debris). The road milling machine 30 includes a conveyor 38 from which asphaltic debris (or milling debris) exits during operation. U.S. Pat. No. 7,144,192 to Holl et al. for a SELF-PROPELLED ROAD MILLING MACHINE, U.S. Pat. No. 7,370,916 to Ley et al. for a REAR LOADER ROAD MILLING MACHINE WITH HEIGHT-ADJUSTABLE SEALING DEVICE, and U.S. Pat. No. 7,070,244 to Fischer et al. for a ROAD MILLING MACHINE disclose exemplary road milling machines.

During operation of the road milling machine, the support block experiences wear due to exposure thereof to the cutting debris. Over time, wear and other kinds of abuse causes the support block to be ineffective which signals an end to its useful life. Once this occurs, the operator must cut or torch the support block off the drum to allow for replacement of the support block. Typically, the operator welds the replacement support block to the drum. As the skilled artisan appreciates, it is time-consuming and hence costly, to remove and replace a support block. Thus, there is an advantage to be able to prolong the useful life of the support block. The present invention provides for that advantage.

The cutting bits and cutting bit holders are subjected to considerable stresses during road milling operations. Accordingly, there is a desire to mount the cutting bit holder in the support block to minimize movement of the cutting bit holder in order to maximize the useful life of the cutting bit. It is also important that the mounting between the cutting bit holder and the support block be resistant to vibratory loosening which could likewise lead to premature cutting bit wear and failure. The present invention provides a secure mounting of the cutting bit to the cutting bit holder and of the cutting bit holder to the support block.

A mining machine or a road milling machine operates typically in severe operating conditions. During operation, the cutting bit holder (or tool holder) and/or the support block (or base) can experience damage such that it is difficult to disassemble these components. It is an advantage to be able to disassemble the cutting bit holder from the support block. Thus, it would be highly desirable to provide a cutting bit holder-support block assembly that facilitates a relatively easy disassembly of the cutting bit holder from the support block. Further, during operation, the severe operating conditions can also cause the rotatable cutting bit to lodge in the bore of the cutting bit holder. It would be advantageous to disassemble the cutting bit from the cutting bit holder. Thus, it is highly desirable to provide a cutting bit-cutting bit holder assembly that facilitates the relatively easy disassembly of the cutting bit from the cutting bit holder.

Figure 2:
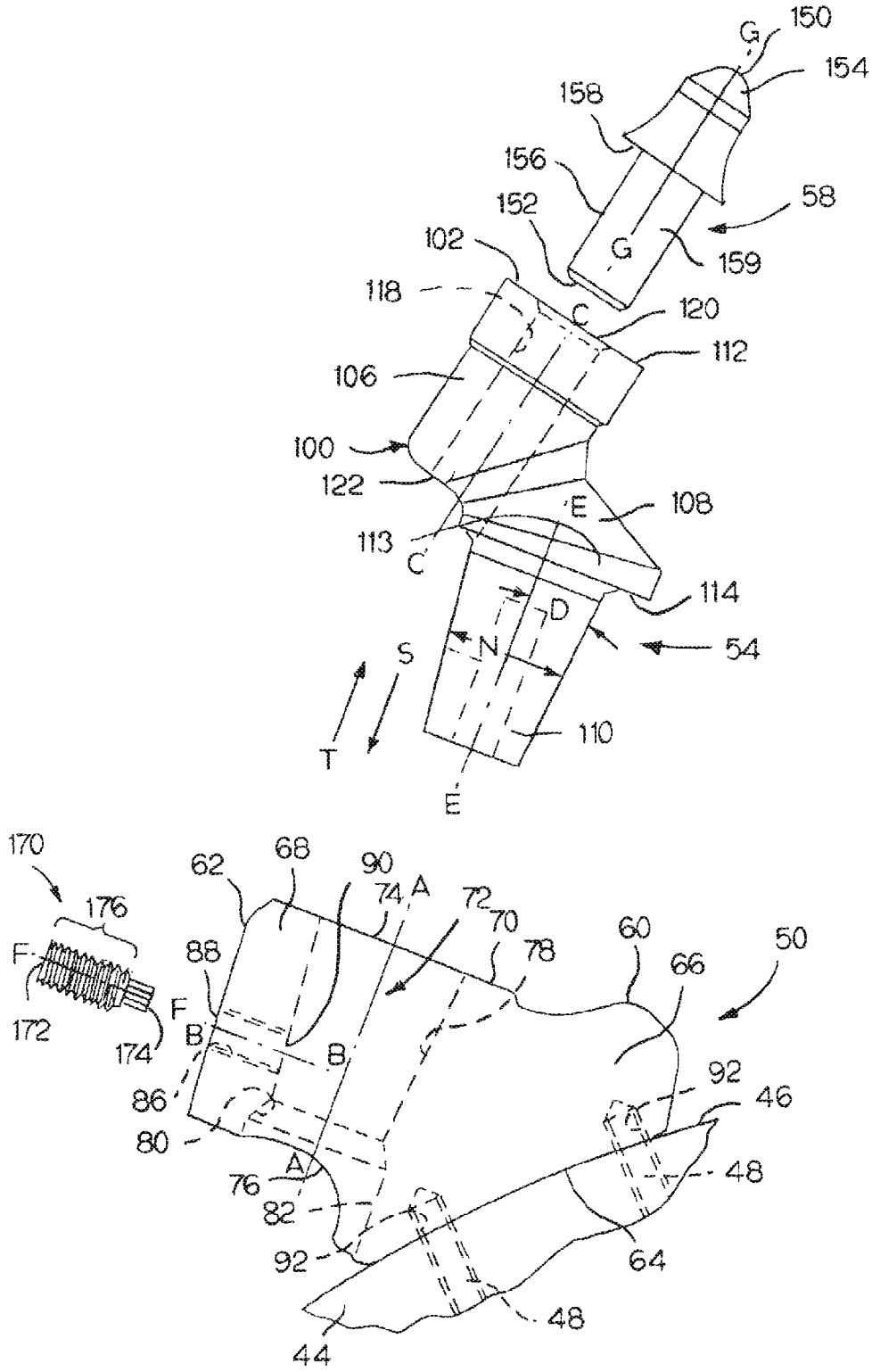
FIG. 2 is a side view of a first specific embodiment of the inventive cutting bit assembly including the support block, the cutting bit holder and the cutting bit wherein these components are exploded away from each other, as well as the threaded cam pin exploded away from the support block.
Figure 3:
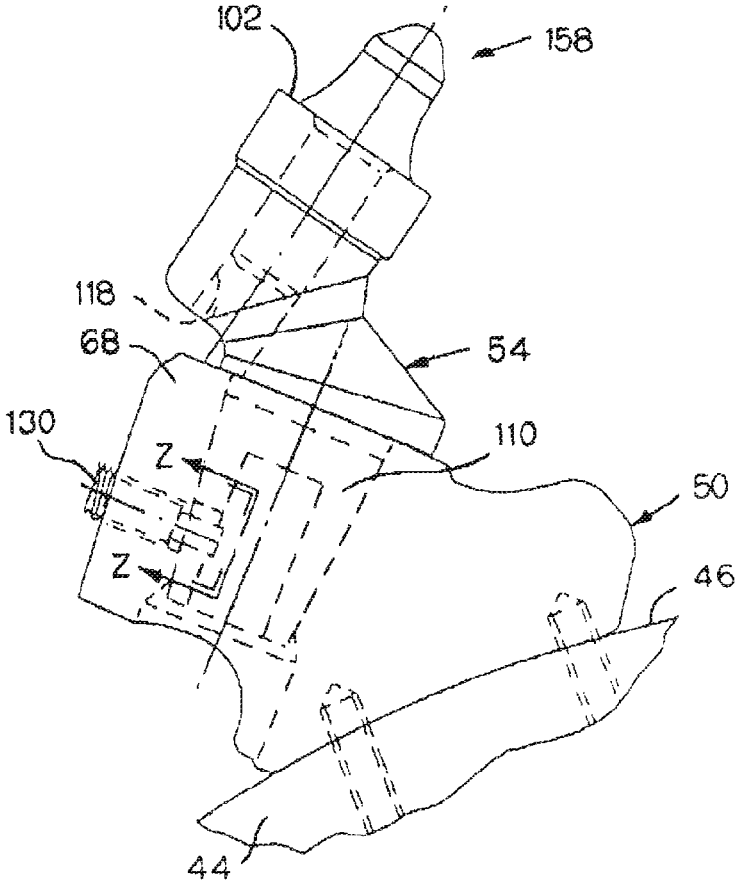
FIG. 3 is a side view of the cutting bit assembly of FIG. 2 in an assembled condition.

Referring to the drawings and especially FIG. 2 and FIG. 3, the cutting bit assembly comprises the combination of the support block 50, the cutting bit holder 54 and the cutting bit 58. FIG. 2 illustrates these three components in an exploded fashion. The cutting bit retention assembly comprises the components of the support block 50 and the cutting bit holder 54. A description of each component now follows.

Support block 50 has a block body 60 which has a top end 62 and a bottom end 64. The bottom end 64 is generally arcuate to conform with the curvature of the cylindrical surface 46 of the drum 44. The block body 60 includes a base 66 and an integral protrusion 68, which has a forward face (or surface) 70. The protrusion 70 of the block body 60 contains a cutting bit holder bore 72, which has an axial forward end 74 and an axial rearward end 76. The cutting bit holder bore 72 has a central longitudinal axis A-A.

The cutting bit holder bore 72, which is an open bore, has an axial forward end and an axial rearward end. There is access to the rearward end of the tool holder through the axial rearward end of the cutting bit holder bore 72. Through this access, the operator can cause an impact on the rearward end of the tool holder to facilitate to disassembly of the tool holder from the base. As mentioned above, during operation, the tool holder and/or the base may suffer damaged or at least impacted so that disassembly is difficult. The above access facilitates the disassembly of the cutting bit holder from the support block. This is an advantage provided by the present invention.

The cutting bit holder bore 72 has a major frusto-conical bore section 78 wherein the transverse dimension thereof decreases in the axial rearward direction. The major frusto-conical bore section 78 is at the axial forward end 74 of the cutting bit holder bore 72. The cutting bit holder bore 72 has a minor frusto-conical bore section 80 wherein the transverse dimension thereof increases in the axial rearward direction. In reference to the major frusto-conical bore section 78 and the minor frusto-conical bore section 80, the transverse dimension is the dimension perpendicular to the central longitudinal axis A-A of the cutting bit holder 72. Finally, the cutting bit holder 72 has a cylindrical bore section 82 at the axial rearward end 76 thereof. The minor frusto-conical bore section 80 is mediate of and contiguous with the major frusto-conical bore section 78 and the cylindrical bore section 82. The cutting bit holder bore 72 is adapted to receive the shank section 110 of the cutting bit holder 54.

The support block 50 further contains a threaded bore (or transverse bore) 86, which has a central longitudinal axis B-B. Threaded bore 86 has an exterior end 88 at the surface of the block body 60 and an interior end 90 adjacent the cutting bit holder bore 72. The threaded bore 86 opens into the cutting bit holder bore 72 of the support block 50. The central longitudinal axis B-B of the threaded bore 86 is generally transverse at an angle of 90° (or perpendicular) to the central longitudinal axis A-A of the cutting bit holder bore 72. As will become apparent from the description hereinafter, the threaded bore 86 threadedly receives a threaded cam pin 170.

The support block 50 also contains a pair of closed bores 92 which open at the bottom surface 64. These closed bores 92 are adapted to receive upstanding posts 48 that protrude from the surface 46 of the drum 44. These posts 48 facilitate the attachment and positioned of the support blocks 50 on the surface 46 of the drum 44. In this regard, support blocks 50 are typically distributed over and mounted to, such as by welding, the circumference and length of the drum 44 according to any desired pattern. A conventional and suitable power source drives the drum to cause the cutting bits 58 to impinge and break up the earth strata thereby generating cutting debris.

The cutting bit holder 54 includes a holder body generally designated as 100 that has a forward (or leading) end 102 and a rearward (or trailing) end 104. Cutting bit holder 54 has a head section 106 adjacent to the leading end 102, and a mediate section 108 contiguous with and axial rearward of the head section 106. The cutting bit holder 54 further includes a shank section 110 contiguous with and axial rearward of the mediate section 108. Shank section 110 has a central longitudinal axis E-E. The shank section 110 presents a generally frusto-conical shape. In this regard, the shank section 110 has a transverse dimension "N", which is generally perpendicular to axis E-E, that decreases in the axial rearward direction. The shank section 110 decreases in its transverse dimension at an angle "D". In other words, the shank section 110 has an angle of taper "D". This taper is a self-locking and self-releasing taper. The angle of taper D ranges between about 5 degrees and about 15 degrees. The preferred angle of taper D is equal to about 11 degrees. Although the shank section 110 presents a frusto-conical shape, there is the contemplation that the shank section may present a geometry other than frusto-conical such as, for example, cylindrical. The head section 106 has a forward face 112 at the leading end 102. The mediate section 108 has an enlarged diameter (or transverse dimension) collar 113 and a collar face 114 that faces in the axial rearward direction.

The head section 108 contains a cylindrical cutting bit bore 118 that has a forward end 120 and a rearward end 122. Cylindrical bore 118 has a central longitudinal axis C-C. Cylindrical bore 118 is adapted to receive the cutting bit 58 as will be described hereinafter. The central longitudinal axis C-C of the cylindrical bore 118 is not in axial alignment with the central longitudinal axis A-A of the cutter bit holder bore 72.

Referring to FIGS. 2, 6, 6A and 7, the shank section 110 contains an elongate slot 130. The elongate slot 130 has an open end 134, which opens at the trailing end 104 of the holder 54. The slot 130 has a closed end 136 that forms the axial forward termination of the elongate slot 130, which is axial rearward of the collar face 114 of collar 113. The shank section 110 further contains a central longitudinal closed bore 140. Closed bore 140 has a closed end 142 and an open and 144.

Figure 6:
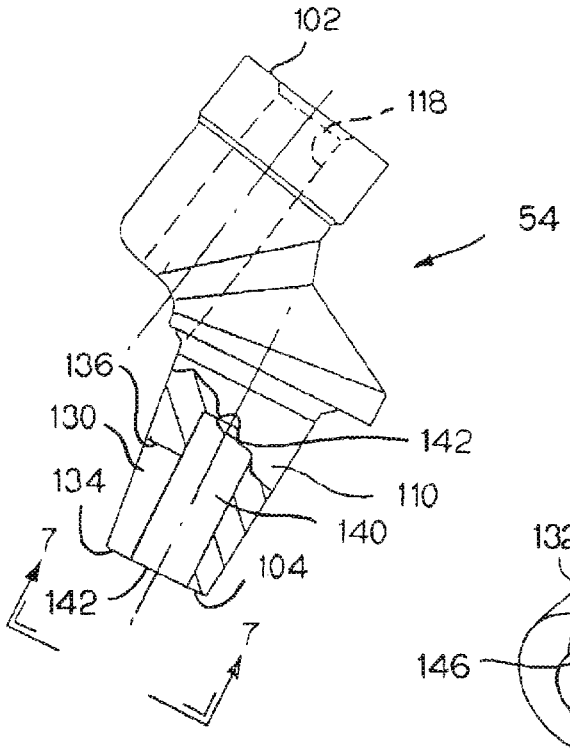
FIG. 6 is a side view of the cutting bit holder of the specific embodiment of FIG. 2 with a section of the shank section of the cutting bit holder cut away.
Figure 6A:
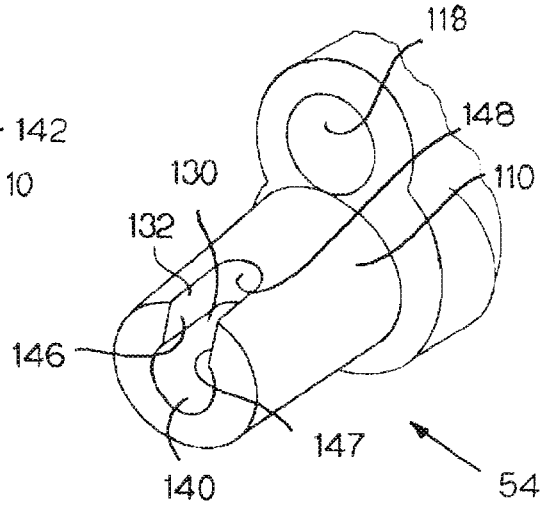
FIG. 6A is an isometric view of the rearward end of the cutting bit holder illustrating the central longitudinal bore and the elongate slot in the shank section.
Figure 7:
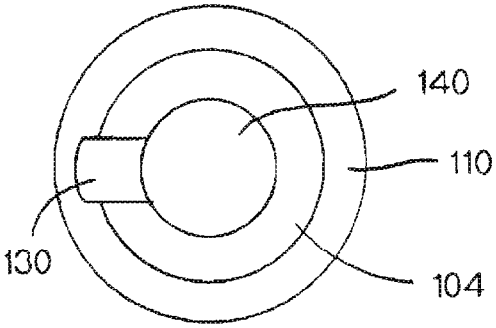
FIG. 7 is a end view of the cutting bit holder of FIG. 6 illustrating only the shank section of the cutting bit holder.
Figure 8:
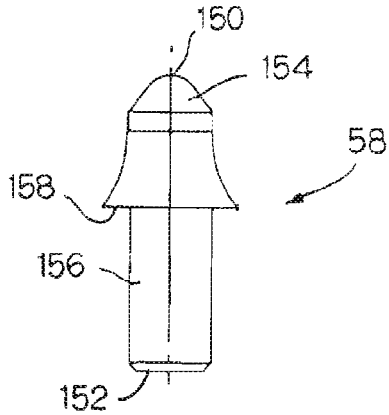
FIG. 8 is a side view of the cutting bit of the specific embodiment of the cutting bit assembly of FIG. 2.

The overall slot surface 132 defines the elongate slot 130. The overall slot surface 132 comprises a pair of spaced-apart generally planar side surfaces 146, 147 and an arcuate surface 148. The arcuate surface 148 joins the side surfaces 146 and 147. As shown in FIGS. 6A and 7, the side surfaces 146 and 147 are generally parallel with respect to each other.

The cutting bit 58 typically has an elongated body that has an axial forward end 150 and an axial rearward end 152. The cutter bit 58 has a central longitudinal axis G-G. The cutting end of the cutting bit 58 typically comprises a hard cutting insert 154, which can be cemented carbide, mounted by brazing or the like at the axial forward end of the cutting bit body. The cutting bit 58 further includes a cutting bit shank section 159 adjoining a rearwardly facing surface 158. A skilled artisan is familiar with cutting bits so that the cutting bit 58 needs no further description herein. An exemplary patent document that discloses a cutting bit is U.S. Pat. No. 4,497,520 to Ojanen.

The cutting bit bore 118, which is a open bore, has an axial forward end 120 and an axial rearward end 122. There is access to the rearward end 152 of the cutting bit 58 through the axial rearward end 122 of the cutting bit bore 118. Through this access, the operator can cause an impact on the rearward end of the cutting bit to facilitate disassembly of the cutting bit from the cutting bit holder. As mentioned above, during operation, the cutting bit and/or the cutting bit holder may suffer damage or at least impact such that disassembly is difficult. The above access facilitates the disassembly of the cutting bit from the cutting bit holder. This is an advantage provided by the present invention.

Figure 4:
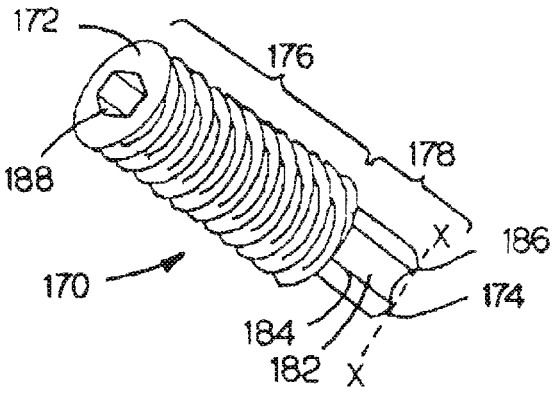
FIG. 4 is an isometric view of the threaded cam pin, which when in use is threadedly received in a threaded bore in the support block.
Figure 5:
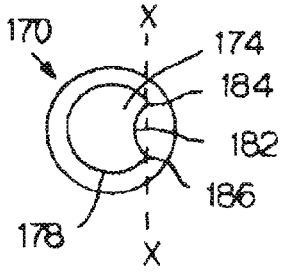
FIG. 5 is an end view of the threaded cam pin of FIG. 4 showing the end of the camming section.

Referring to FIG. 4 and FIG. 5, the cutting bit retention assembly further includes a threaded cam pin (or retention pin) generally designated as 170. The threaded cam pin 170 has an external end 172 and an opposite internal end 174. The threaded cam pin 170 has a threaded section (bracket 176) and a smooth camming section (bracket 178). The camming section 178 is generally cylindrical in geometry, except that an arcuate notch 182 is in the camming section 178. The arcuate notch 182 travels the axial length of the camming section 178. A pair of opposite edges 184, 186 define the periphery of the arcuate notch 182. As shown in FIGS. 4 and 5, a straight line or chord X-X passes through the opposite edges 184, 186.

Figure 11:
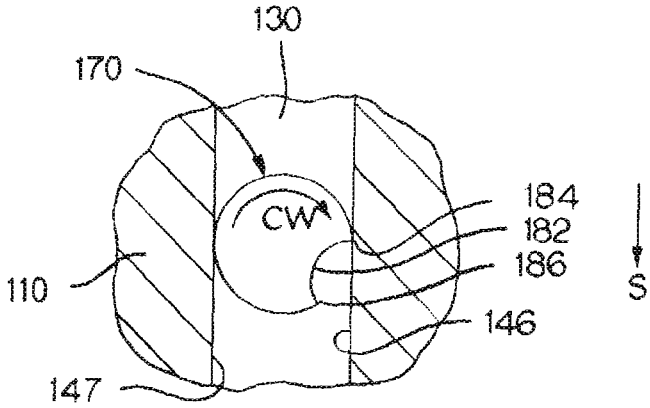
FIG. 11 is a cross-sectional view of the assembled cutting bit assembly taken along section line Z-Z of FIG. 3 showing the threaded cam pin in engagement with the slot wall after clockwise rotation to urge the cutting bit holder into the support block.
Figure 12:
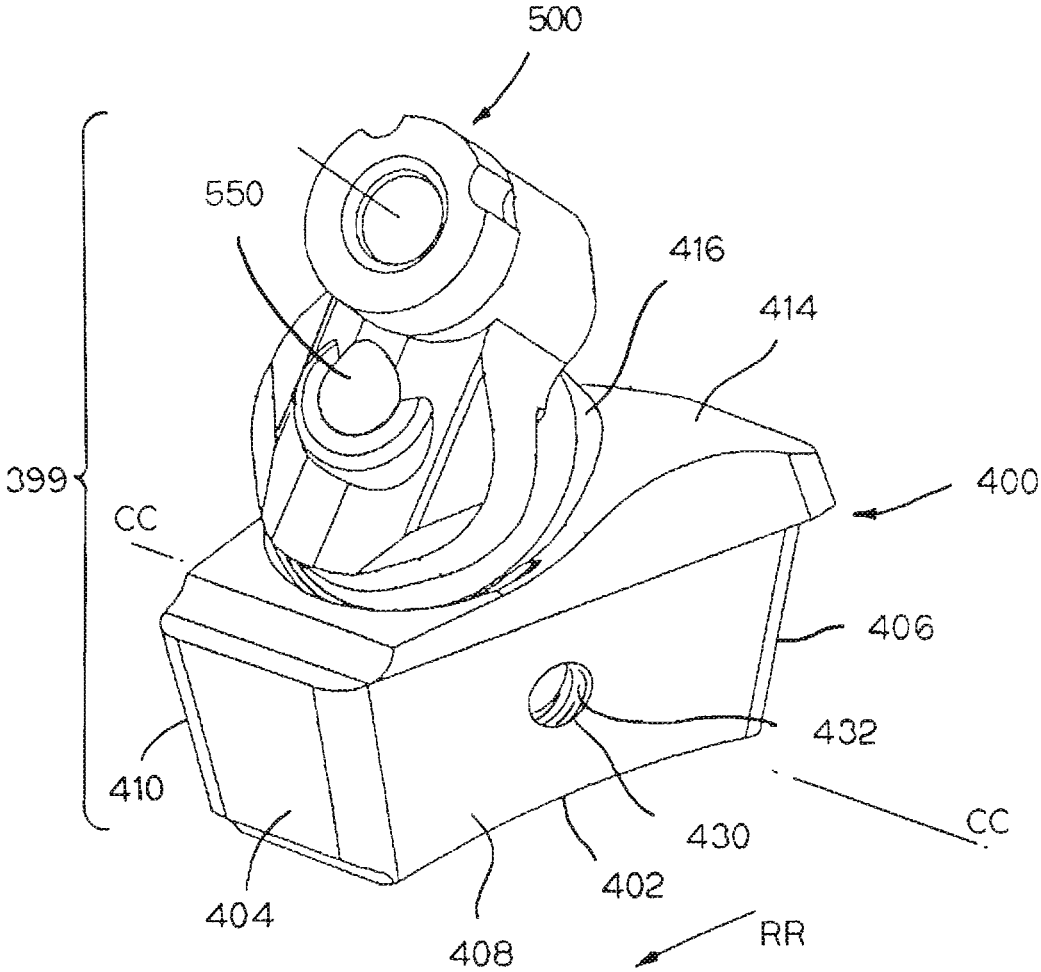
FIG. 12 is an isometric view of the tool holder-base assembly of another specific embodiment of the invention.

As is apparent from a consideration of FIG. 2 and FIG. 11, the threaded cam pin 170 threads into the threaded bore whereby the camming section 178 extends into the cutting bit holder bore 72. While the extent to which the threaded cam pin 170 threads into the threaded bore can vary, the threaded cam pin 170 functions as an alignment guide for the insertion of the cutting bit holder 54 when it extends into the cutting bit holder bore 72.

In regard to the assembly of the cutting bit holder 54 to the support block 50, one inserts the shank portion 110 of the cutting bit holder 54 into the cutting bit holder bore 72 (of the support block 50) as the first step to connecting the cutting bit holder 72 to the support block 50. One can achieve correct relative alignment between the cutting bit holder 54 and the block 50 when the threaded cam pin 170 aligns with the elongate slot 130. The cutting bit holder 54 is fully within the cutting bit holder bore 72 when the collar face 114 (of the collar 113) contacts against the forward face 70 of the block body 60 such as shown in FIG. 2.

Figure 10:
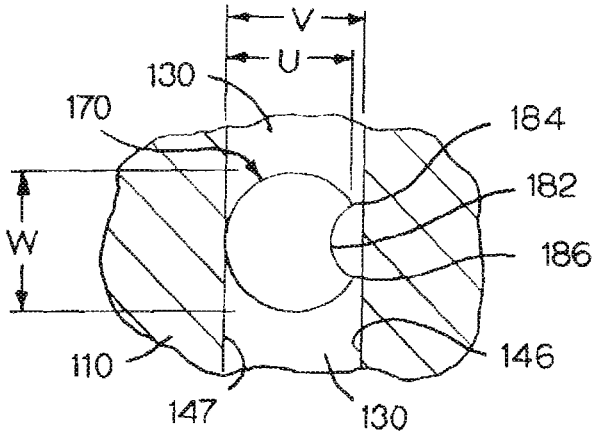
FIG. 10 is a cross-sectional view of the assembled cutting bit assembly taken along section line Z-Z of FIG. 3 showing the threaded cam pin in a neutral position in which the threaded cam pin does not engage the slot wall so that the shank section is free to be inserted into the cutting bit holder bore of the support block.

In order for the slot 130 to accommodate the threaded cam pin 170, the threaded cam pin 170 must present the orientation, which is a neutral position, as shown in FIG. 10. More specifically, the threaded cam pin 170 is threaded into the threaded bore 86 in the support block 50 to a depth so that the threaded cam pin 170 satisfies two conditions. One such condition is that the camming section 178 extends into the cutting bit holder base 72. When in this condition, the threaded camming pin 170 provides an alignment feature to correctly align the cutting bit holder with the support block.

The other condition is that the camming section 178 has an orientation as illustrated in FIG. 10. When in the condition shown by FIG. 10, the chord (i.e., the straight line X-X) between the opposite edges 184, 186 is generally parallel to the side slot walls 146, 147 that define the slot 130. When in this condition, the minimum transverse dimension "U" (see FIG. 10) of the camming section 178 is aligned with the slot 130, which has a width of "V" (see FIG. 10). Width V of the slot 130 is greater than the minimum transverse dimension U so that the slot 130 accommodates travel of the camming section 178 therethrough whereby the cutting bit holder 54 slides past the camming section 178 into the cutting bit holder bore 72.

After the cutting bit holder 54 has been fully inserted into the cutting bit holder bore 72, FIG. 10 illustrates the relationship between the camming section 178 of the threaded camming pin and the walls of the slot. At this stage in the assembly process, the operator will draw the shank section 110 of the cutting bit holder 54 into tight engagement within the cutting bit holder bore 72 of the support block 50. The operator achieves this through rotation of the threaded camming pin 170.

More specifically, referring to FIGS. 10 and 11, the operator rotates the threaded camming pin 170 in the clockwise direction (see the arrow marked CW in FIG. 11) as viewed in FIG. 11 until the edge 184 of the notch 180 contacts (or engages) the side surface 146 of the notch 130. The engagement occurs because the maximum transverse dimension for diameter "W" of the camming section 178 is greater than the width V of the slot 130. Thus, during the clockwise rotation of the threaded camming pin 170 there is a position in which the camming section 178 engages the slot wall 146. Here, this position occurs when edge 184 contacts of the wall 146.

As the operator continues to rotate the threaded camming pin 170, the camming section 178 continues to engage the slot wall 146 thereby forcing or moving the cutting bit holder 54 in a direction (see the arrow "S" in FIGS. 2 and 11) toward the support block 50. Finally, the threaded camming pin 170 is rotated to a point where the cutting bit holder 54 is firmly and securely retained to the support block 50.

Figure 9:
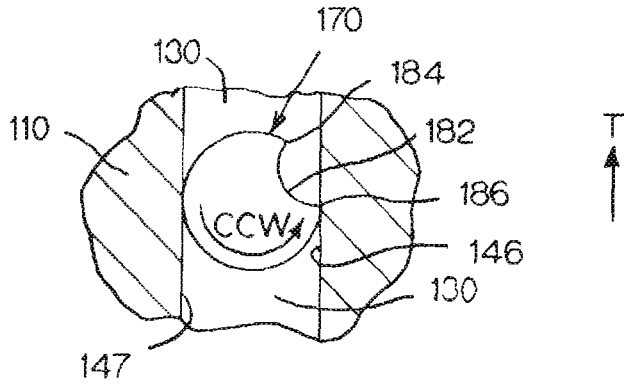
FIG. 9 is a cross-sectional view of the assembled cutting bit assembly taken along section line Z-Z of FIG. 3 showing the threaded cam pin in engagement with the slot wall after counter-clockwise rotation to urge the cutting bit holder away from the support block.

When the cutting bit holder 54 is secured to the support block 50, there most likely will be a time when the operator will want to disconnect these two components. The operator can rotate the threaded cam pin 170 in the counter-clockwise direction (see the arrow CCW in FIG. 9) as viewed in FIG. 9. Such counterclockwise rotation will cause the camming section 178 to disengage the slot surface 146, move into the neutral position as shown in FIG. 10, and then rotate into the position shown in FIG. 9. In the position shown in FIG. 9, the edge 186 engages the slot surface 146. As the operator continues to rotate the threaded camming pin 178 in the counter-clockwise direction, the camming section 178 continues to engage the slot wall 146 to force or move the cutting bit holder 54 in the direction (see the arrow "T" in FIG. 2 and FIG. 9) away from the support block 50. Such movement essentially disengages the cutting bit holder 54 from the support block 50 to the extent that the operator can disconnect these components by any commonly used means such as, for example, an impact on the cutting bit holder from a hammer.

In light of the above description of the assembly and disassembly of the cutting bit holder to the support block, it is thus apparent that the retention pin can be selectively in different positions. On one position, the retention pin is in a non-retaining position wherein the retention pin does not engage the slot surface. The retention pin can be is a retaining position in which the retention pin engages the slot surface to urge the cutting bit holder into the cutting bit holder bore. The retention pin can be in an ejecting position in which the retention pin engages the slot surface to urge the cutting bit holder out of the cutting bit holder bore.

There is the contemplation that one could use a set screw or the like in place of the threaded camming pin as the retention pin. However, if this were the case, the set screw would be of a length to extend to engage the surface that defines the central longitudinal bore 140 in the shank section 110. Such engagement would retain the cutting bit holder in the cutting bit holder bore of the support block. As an alternative, the set screw would present a geometry to engage the side slot walls to retain the cutting bit holder in the cutting bit holder bore of the support block.

There is now an appreciation that during operation of the mining or construction machine, the support block experiences wear due to exposure thereof to the cutting debris. The use of the cutting bit holder increases the overall useful life of the support block. By doing so, there is less time spent on replacing support blocks, which results in an overall savings for the operator. The present invention thus provides a significant advantage to the operator.

There is also the appreciation that the present cutting bit holder securely mounts in the support block to minimize movement of the cutting bit holder in order to maximize the useful life of the cutting bit. Such a secure connection also is resistant to vibratory loosening, which could likewise lead to premature cutting bit wear and failure. It is apparent that the present invention provides a significant advantage to the operator.

Referring to FIGS. 12-18, there is illustrated another specific embodiment of a retention assembly for a cutting bit (or cutting tool). The retention assembly is a tool holder-base assembly designated by brackets as a 399. This embodiment of the tool holder-base assembly provides certain advantages as set forth below.

During operation of the road milling machine, the base (or support block) experiences wear due to exposure thereof to the cutting debris. Over time, wear and other kinds of abuse causes the base to be ineffective which signals an end to its useful life. Once this occurs, the operator must cut or torch the base off the drum to allow for replacement of the base. Typically, the operator welds the replacement base to the drum. As the skilled artisan appreciates, it is time-consuming and hence costly, to remove and replace a base. Thus, there is an advantage to be able to prolong the useful life of the base. The present invention, including the specific embodiment of FIGS. 12-17, provides for that advantage.

Further, the cutting tools and cutting tool holders are subjected to considerable stresses during road milling operations. Accordingly, there is a desire to mount the cutting tool holder in the base to minimize movement of the cutting tool holder in order to maximize the useful life of the cutting tool. It is also important that the mounting between the cutting tool holder and the base be resistant to vibratory loosening which could likewise lead to premature cutting tool wear and failure. The present invention, including the specific embodiment of FIGS. 12-18, provides a secure mounting of the cutting tool holder to the base that is resistant to vibratory loosening.

Tool holder-base assembly 399 comprises a base generally designated as 400. The base 400 has an arcuate surface 402 by which one can attach (for example, by welding) the base 400 to the surface of a driven member (for example, a road milling drum). Base 400 further comprises a leading base surface 404, a trailing base surface 406, one side base surface 408, another side base surface 410, and a top base surface 414. Although the base 400 is not shown attached to the driven member, the direction of the rotation is shown by arrow "RR" in FIG. 12.

A collar 416 extends away from the top base surface 414. A tool holder bore 418 travels through the base 400. The collar 416 surrounds the bore 418 at the leading open end 420 thereof. The bore 418 further has a trailing open end 422. The bore 418 presents a tapered, frusto-conical bore surface 424. The bore 418 has a central longitudinal axis AA-AA. The half angle of taper (BB-BB) of the bore surface 424 is equal to between about 2½ degrees and about 5½ degrees with the preferred half-angle being equal to about 5½ degrees.

There should be an appreciation that the base 400 further contains a transverse passage 430. The central longitudinal axis CC-CC of the transverse passage 430 is generally perpendicular (ninety degrees) to the central longitudinal axis AA-AA of the tool holder bore in the base 400. Transverse passage 430 passes from one side base surface 408 to the other side base surface 410. Transverse passage 430 intersects the bore 418 at a location so as to create an open elongate slot 431 in the surface 424 of the bore 418. The transverse passage 430 has a threaded portion 432 that extends from the one side base surface 408 a pre-determined distance toward the tool holder bore 418. The remainder of the transverse passage 430 is threaded, which includes all of the transverse passage 430 between the other side base surface 410 and the tool holder bore 418.

A threaded cam pin 670 passes into the transverse passage 430 in a fashion as described hereinafter. As also described hereinafter, an operator can operate the threaded cam pin 670 to tighten (or help tighten) the attachment between the tool holder 500 and the base 400. An operator can operate the threaded cam pin 670 to disengage (or help disengage) the tool holder 500 from engagement with the base 400. The operation of the threaded cam pin 670 is described hereinafter, Referring to the drawings, and especially the drawing of the tool holder 500 in FIG. 12, FIG. 17 and FIG. 18, there is illustrated a tool holder generally designated as 500. The tool holder 500 has a head region 502 and an integral shank region 504. The head region 502 is axial forward of the shank region 504. The head region 502 contains a rotatable cutting tool bore 506. The rotatable cutting tool bore 506 has an axial forward end 508 and an axial rearward end 510. The head region 502 has a leading surface 512 adjacent the bore 506 and a trailing surface 514 adjacent the bore 506. The head region 502 also has a leading protective surface 516 and a corresponding trailing surface 518. As understood by those of ordinary skill in the art, the bore 506 typically receives a rotatable cutting tool therein. As mentioned hereinafter, an exemplary cutting tool is shown and described in U.S. Pat. No. 4,497,520 to Ojanen.

The head region 502 contains a positioning bore 550 that has a mediate threaded cylindrical surface 552. The positioning bore 550 has a forward end 556 and a rearward end 558. The bore 550 further includes a smooth forward region 590 that extends between the forward end 556 and the mediate threaded surface 552, as well as a smooth rearward region 592 that extends between the rearward end 558 and the mediate threaded surface 552. As will be described in more detail hereinafter, the threaded bore 550 is adapted to receive the threaded section of an installation-removal tool 600. The operator can use the installation-removal tool 600 to better position the tool holder 500 in relation to the base 400 in both the attachment of the tool holder to the base and the detachment of the tool holder 500 from the base 400. There should be an appreciation that the bore 550 may be partially threaded or it may be fully threaded. In other words, substantially all of the surface of the bore 550 may be threaded.

The shank region 504 projects from the trailing surface 518 of the head region 502. The shank region 504 has a leading end 522 and an opposite distal trailing end 524. The shank region 504 has a central longitudinal axis EE-EE. The shank region 504 present an alignment region 528 defined by a flat surface 530. The flat surface 530 is of a depth "ZZ" (see FIG. 13B). The alignment region 528 has a stop 560 at the axial forward end thereof. The shank region 504 contains an elongate slot 562 in the flat surface 530 thereof.

Figure 15A:
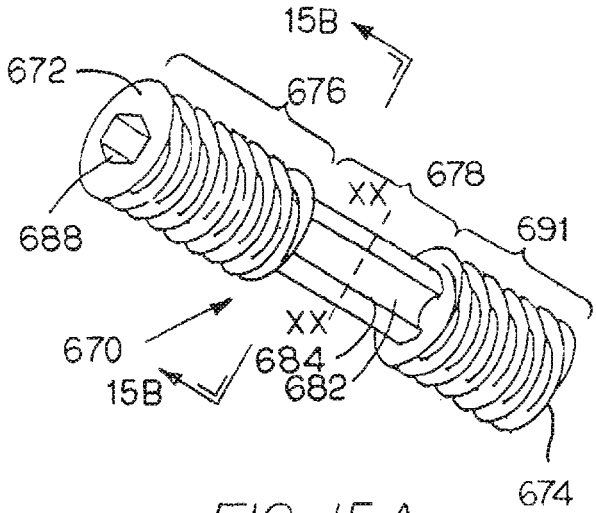
FIG. 15A is an isometric view of the threaded cam pin.
Figure 15B:
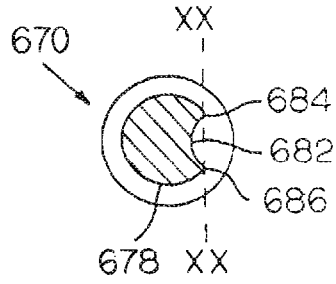
FIG. 15B is a cross-sectional view of the threaded cam pin of FIG. 15A taken along section line 15B-15B.
Figure 17:
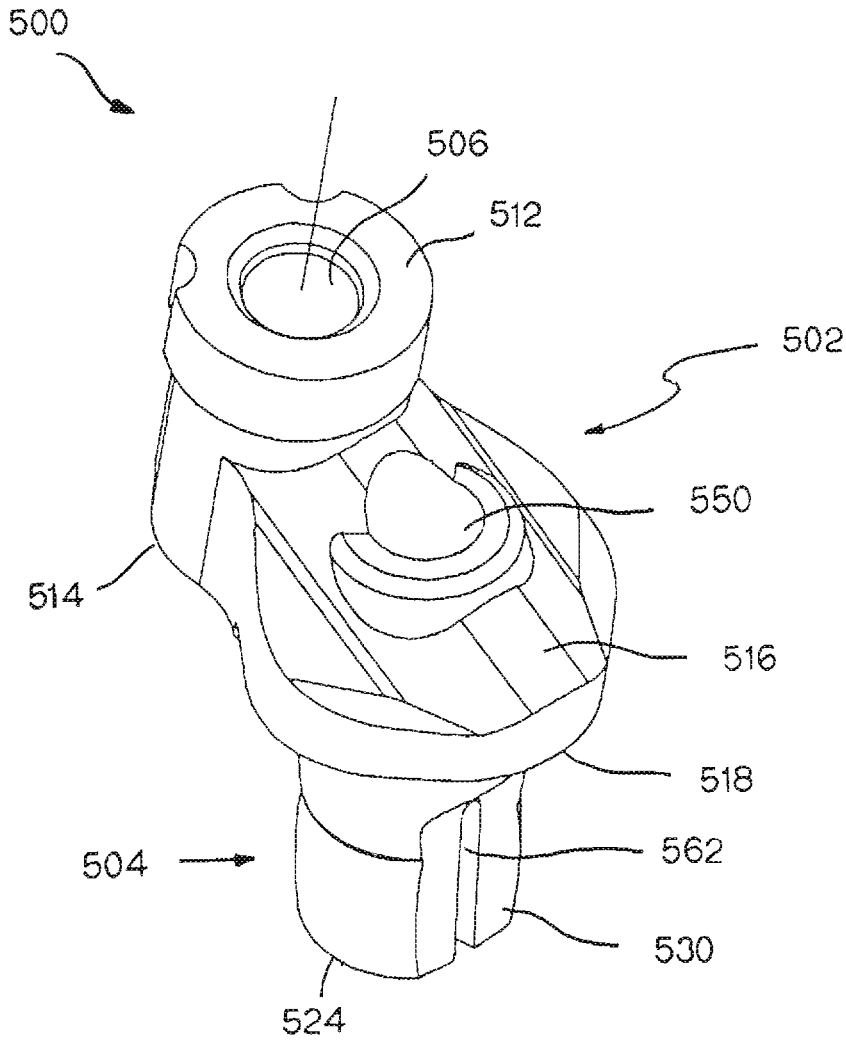
FIG. 17 is an isometric view of the tool holder of the tool holder-base assembly illustrated in FIG. 12.
Figure 18:
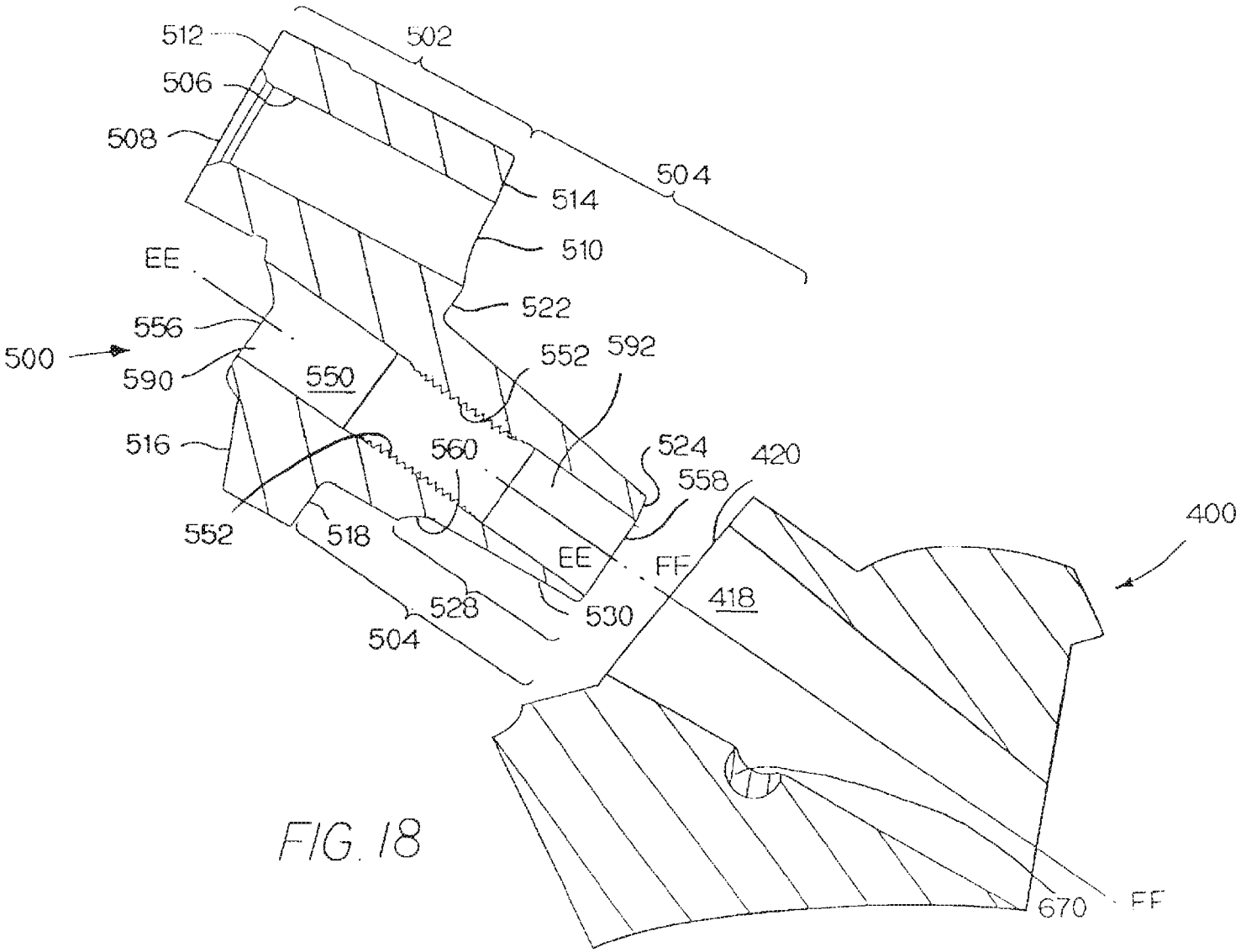
FIG. 18 is a cross-sectional schematic view of the tool holder exploded away from the base.

The threaded cam pin 670 has an end 672 and an opposite end 674. The threaded cam pin 670 has a threaded section (bracket 676) and a smooth camming section (bracket 678) that does not have threads and another threaded section (bracket 691). The camming section 678 is generally cylindrical in geometry, except that an arcuate notch 682 is in the camming section 678. The arcuate notch 682 travels the axial length of the camming section 678. A pair of edges 684, 686, which are opposite one another, define the periphery of the arcuate notch 682. As shown in FIGS. 15A and 15B, a straight line or chord XX-XX passes through the opposite edges 684, 686.

As is apparent from a consideration of the drawings, the threaded cam pin 670 threads into the threaded portion 432 of the transverse passage 430 whereby the camming section 678 extends into the cutting bit holder bore 418. The threaded cam pin 670 functions as an alignment guide for the insertion of the cutting tool holder 500 when it extends into the cutting tool holder bore 418. Thus, as mentioned above, the camming section 678 extends completely across the tool holder bore 418.

In regard to the assembly of the cutting tool 500 to the base 400, one inserts the shank region 504 of the cutting tool holder 500 into the tool holder bore 418 (of the base 400) as the first step to attaching (or connecting) the tool holder 500 to the base 400. To engage the tool holder 500, the operator takes the installation removal tool 600 and inserts the threaded region 612 into the bore 550. The operator then threads the threaded region 612 into mediate threaded surface 552. Once the threaded connection is secure, the operator can then transport or position the tool holder 500 to align and then attach the tool holder 500 to the base 400. After the tool holder 500 attaches to the base 400, the operator can then unthreaded the installation-removal tool 600 from the threaded bore 550.

Figure 13:
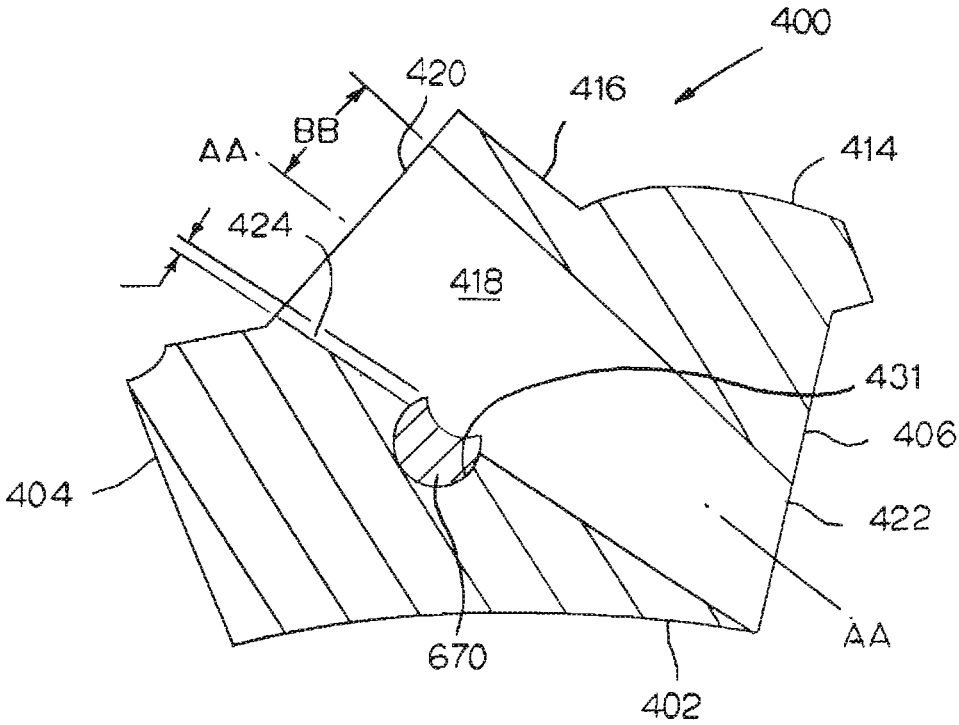
FIG. 13 is a cross-sectional schematic view of the base with the threaded cam pin in a neutral position.
Figure 13A:
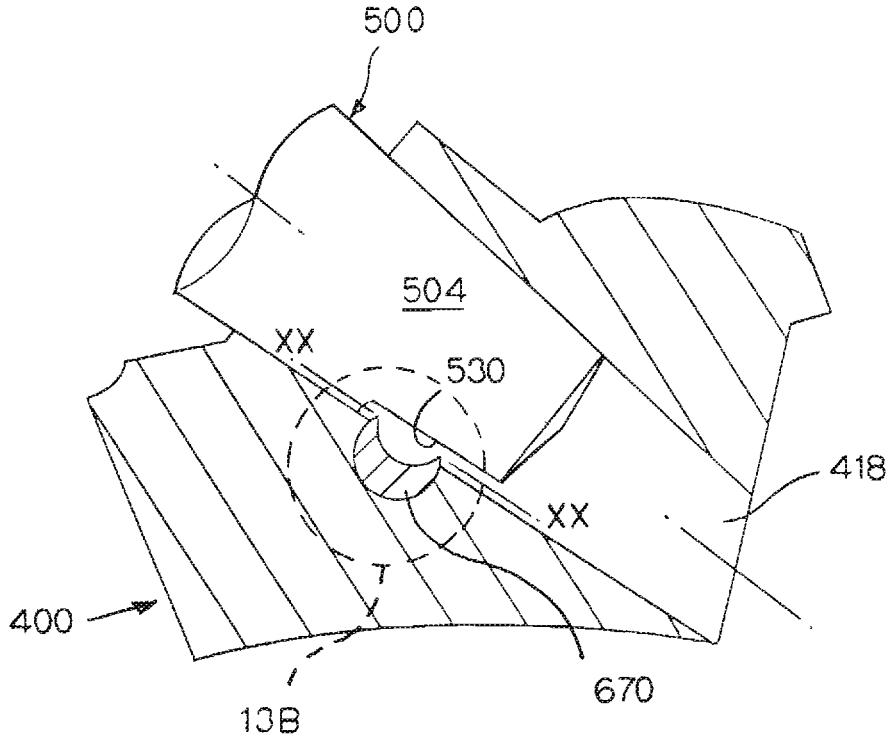
FIG. 13A is a cross-sectional schematic view of the base with the threaded cam pin in a neutral position and the shank region of the tool holder in the tool holder bore of the base whereby the camming section is proximate to the flat surface of the shank region of the tool holder.

One can achieve correct relative alignment between the tool holder 500 and the base 400 when the threaded cam pin 670 has an orientation so that the chord XX-XX is generally parallel to the flat surface 530 of the tool holder 500. FIG. 13A illustrates this orientation of the tool holder 500 relative to the base 400. A more detailed discussion about the relative alignment between the tool holder 500 and the camming section 678 is set forth below.

As one can appreciate, for the shank region 504 of the tool holder 500 to enter the tool holder bore 418, the threaded cam pin 670 must present the neutral orientation such as is shown in FIG. 13A. More specifically, the threaded cam pin 670 is threaded into the threaded portion 432 of the transverse passage 430 so that the threaded cam pin 670 satisfies two conditions. One such condition is that the camming section 678 extends into and through the tool holder bore 418 and into the unthreaded portion of the transverse passage 430. The second condition is that the camming section 678 has an orientation as illustrated in FIG. 13A so that the chord (i.e., the straight line XX-XX) between the opposite edges 684, 686, is generally parallel to the flat surface 530. When in this condition, the threaded camming pin 670 provides an alignment feature to align correctly the tool holder 500 with the base 400.

Figure 13C:
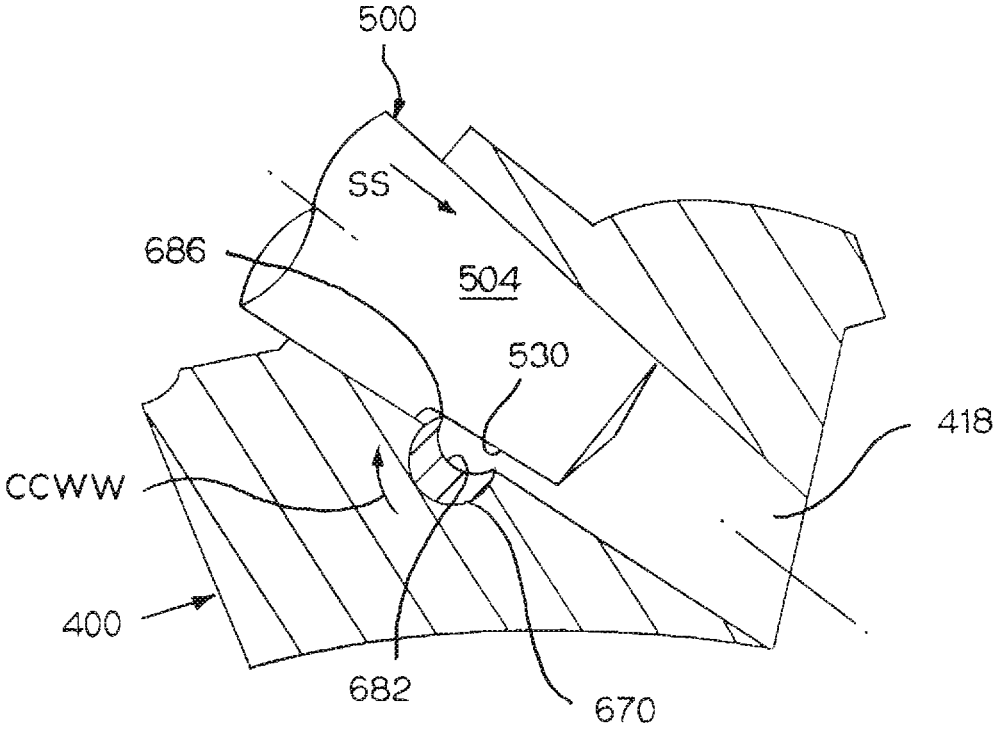
FIG. 13C is a cross-sectional schematic view of the base with the threaded cam pin in a position of initial retention contact with the flat surface of the shank wherein the position of initial retention contact is the result of the clockwise rotation of the threaded cam pin from the neutral position (see FIG. 13A) to the point of initial retention contact.
Figure 13B:
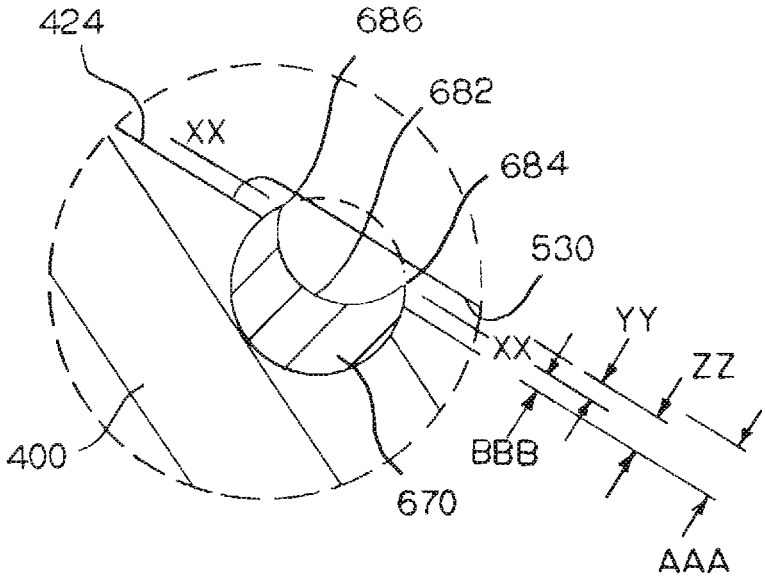
FIG. 13B is an enlarged cross-sectional view of the area of the camming pin and the flat surface of the tool holder from FIG. 13A and shown by the dashed circle marked 13B in FIG. 13A.
Figure 14:
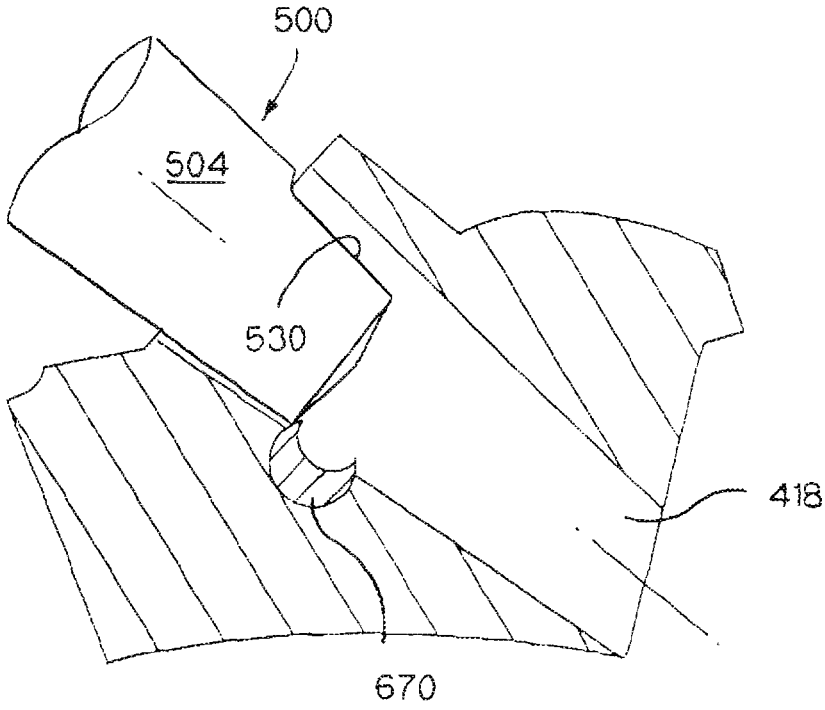
FIG. 14 is a cross-sectional schematic view of the base with the threaded cam pin in the neutral position and the shank region of the tool holder partially within the tool holder bore of the base due to an abutment against the threaded cam pin because of misalignment between the tool holder and the base.
Figure 16:
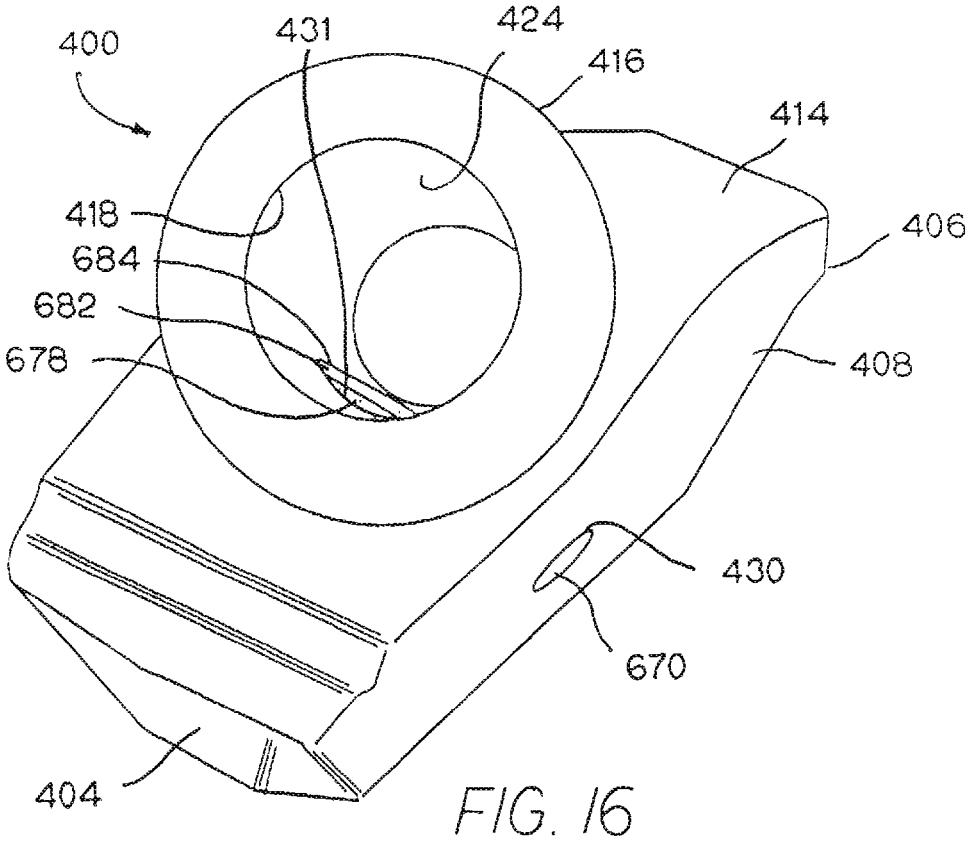
FIG. 16 is an isometric view of the base with the threaded cam pin in the transverse passage.

When the camming section 678 presents the orientation of FIG. 13A, the chord XX-XX is spaced from the flat surface 530 a distance YY (see FIG. 13B). Further, the minimum distance BBB the camming section 678 extends past the surface 424 of the bore 418 is less than the depth ZZ of the alignment region 528. As mentioned above, the camming section 678 extends into the tool holder bore 418. This orientation provides an alignment feature because the tool holder 500 can slide past the camming section 678 and into the tool holder bore 418 only when the flat surface 530 is oriented in a generally parallel fashion to the camming section 678. If one tries to move the shank region 504 of the tool holder into the tool holder bore 418 in another orientation, the shank region 504 abuts against the camming section 678. FIG. 14 shows the abutment of the shank region 504 against the camming section 678. The abutment prevents any further insertion of the shank region 504 of the tool holder 500 into the tool holder bore 418 of the base 400.

After the tool holder 500 has been fully inserted into the tool holder bore 418, FIG. 13A illustrates the relationship between the camming section 678 of the threaded cam pin 670 and the flat surface 530 of the shank region 504. At this stage in the assembly process, through rotation of the threaded camming pin 670, the operator will draw (or help draw) the shank region 504 of the tool holder 500 into tight engagement within the tool holder bore 418 of the base 400.

More specifically, referring to FIGS. 13A through 13D, the operator rotates the threaded cam pin 670 in the clockwise direction (see the arrow marked CCWW in FIG. 13A) as viewed in FIG. 13C until the edge 686 of the notch 682 contacts (or engages) the flat surface 530 of the shank. At this position, the threaded cam pin 670 is in initial contact with the flat surface 530 of the shank region 504. FIG. 13C illustrates the threaded cam pin 670 in this position. The engagement occurs because the maximum distance "AAA" (see FIG. 13B) the camming section 678 could extend past the surface 424 of the bore 418 is greater than the depth "ZZ" of the flat surface 530. Thus, during the clockwise rotation of the threaded camming pin 670, there is a position in which the camming section 678 engages initially the flat surface 530. Here, this position occurs when edge 686 first contacts of the flat surface 530 (see FIG. 13C).

As the operator continues to rotate the threaded cam pin 670 in the clockwise direction, the camming section 678 continues to engage the flat surface 530 thereby forcing or moving the tool holder 500 in a direction (see the arrow "SS" in FIG. 13D) toward the base 400. Finally, the threaded cam pin 670 is rotated to a point where the tool holder 500 is firmly and securely retained to the base 400 as shown in FIG. 13D.

Figure 13D:
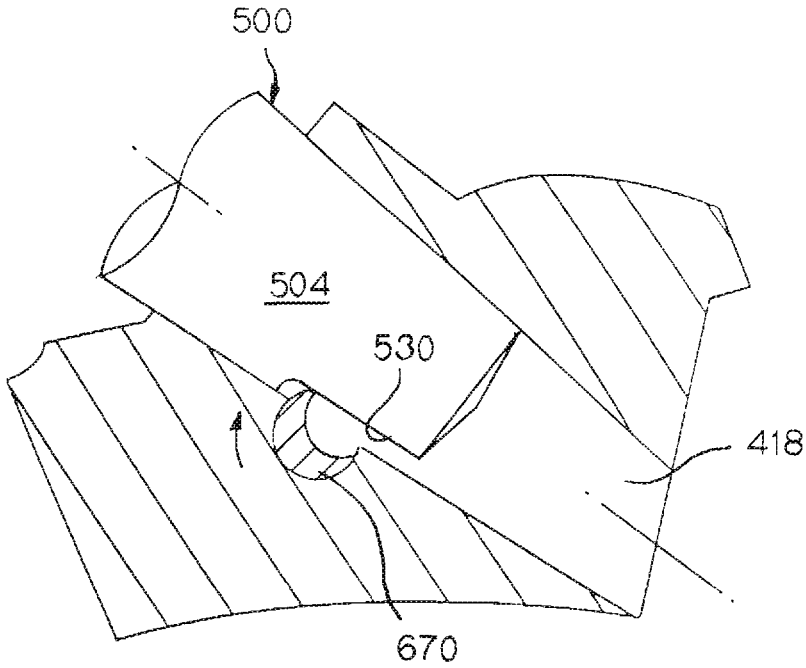
FIG. 13D is a cross-sectional schematic view of the base with the threaded cam pin in a position of maximum retention contact with the flat surface of the shank region wherein the position of maximum retention contact is the result of the clockwise rotation of the threaded cam pin from the position of initial contact (see FIG. 13C) to this position of maximum retention contact.

When in the condition shown in FIG. 13D, the tool holder-base assembly 399 is in a condition suitable for operation. When in this position, the tool holder 500 is tightly engaged to the base 400. The tight engagement causes there to be minimal movement between the cutting tool holder and the base to maximize the useful life of the cutting tool. The tight engagement also makes the connection of the tool holder to the base to be resistant to vibratory loosening which could likewise lead to premature cutting tool wear and failure.

During the operation of the road milling machine, there typically will come a time when it is desirable to detach the tool holder 500 from the base 400. This could be due to any one of a number of circumstances. For example, the tool holder 500 could wear to the point where replacement is necessary. The same could be true for the base in that it could wear to the point requiring replacement. The disconnection of the tool holder 500 from the base 400 is relatively easy and quick as described hereinafter.

Figure 13E:
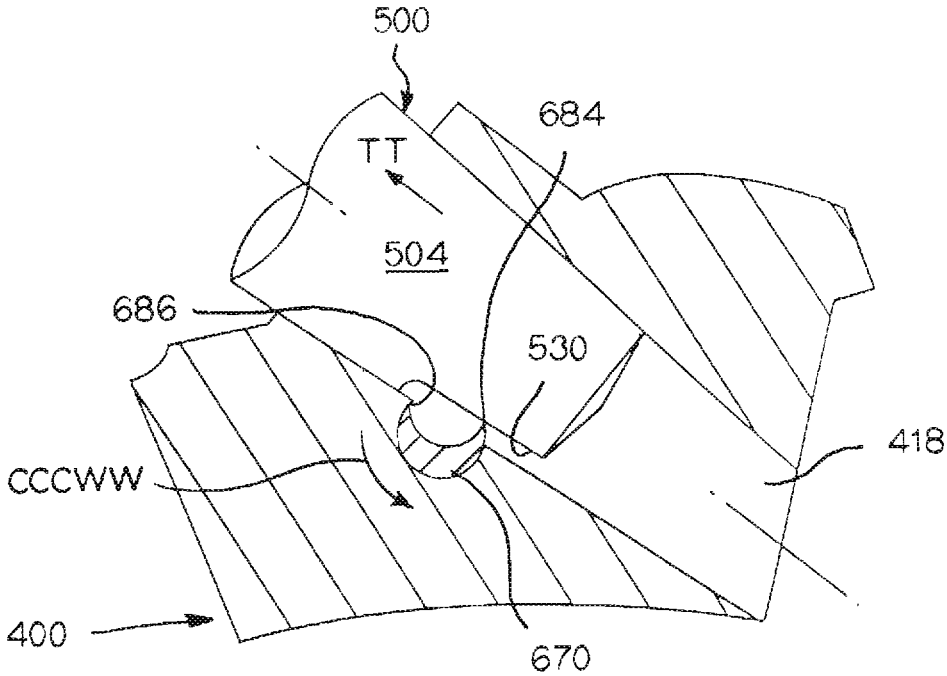
FIG. 13E is a cross-sectional schematic view of the base with the threaded cam pin in a position of initial disengagement contact with the flat surface of the shank region wherein the position of initial disengagement contact is the result of the counterclockwise rotation of the threaded cam pin from the neutral position (see FIG. 13A)

To disconnect the tool holder 500 from the base 400, the operator can rotate the threaded cam pin 670 in the counterclockwise direction (see the arrow CCCWW in FIG. 13E) as viewed in FIG. 13E. Initially, such counterclockwise rotation will cause the camming section 678 to move from the position shown in FIG. 13D so as to disengage the flat surface 530, and then move into the neutral position as shown in FIG. 13A.

Figure 13F:
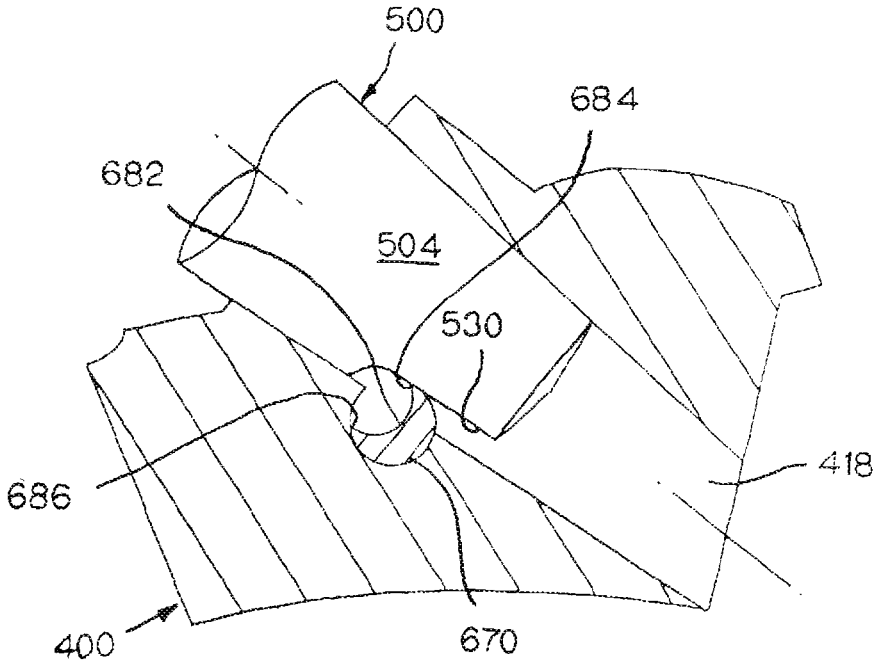
FIG. 13F is a cross-sectional schematic view of the base with the threaded cam pin in a position of maximum disengagement contact with the flat surface of the shank region wherein the position of maximum disengagement contact is the result of the counterclockwise rotation of the threaded cam pin from the position of initial disengagement contact (see FIG. 13E) to this position of maximum disengagement contact.

Once the threaded cam pin 670 is in the neutral position, the operator can then rotate the threaded cam pin 670 in the counterclockwise direction into the position shown in FIG. 13E. In the position shown in FIG. 13E, the edge 684 make initial disengagement contact with the flat surface 530. As the operator continues to rotate the threaded cam pin 678 in the counterclockwise direction, the camming section 678 continues to engage the flat surface 530 to force or move the tool holder 500 in the direction (see the arrow "TT" in FIG. 13E) away from the base 400. Such movement essentially disengages the tool holder 500 from the base 400. FIG. 13F illustrates the disengagement of the tool holder 500 from the base 400. The position of the threaded cam pin 670 as shown in FIG. 13F is the result of additional counterclockwise rotation of the threaded cam pin 670 from the position shown in FIG. 13E to the position shown in FIG. 13F. The extent of the disengagement is such that the operator can disconnect these components by any commonly used means such as, for example, an impact on the cutting bit holder from a hammer.

Figure 19:
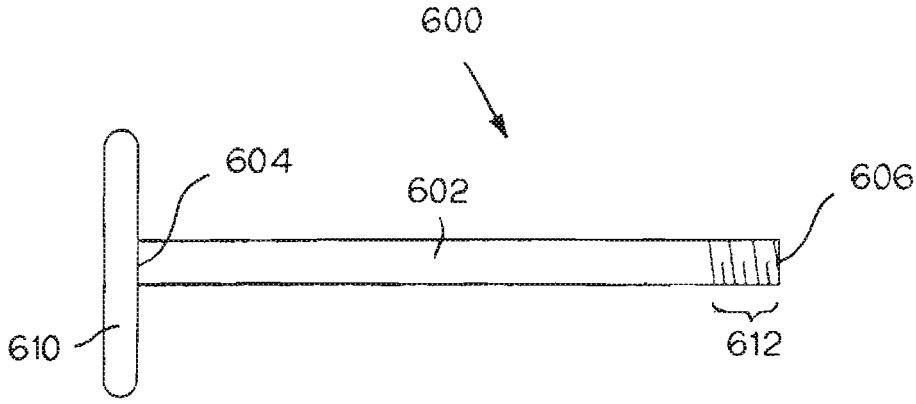
FIG. 19 is a side view of the installation-removal tool for use with the tool holder of FIG. 17.

The operator can also use the installation-removal tool 600 to assist with the detachment of the tool holder 500 from the base 400. Referring to FIG. 19, the installation-removal tool 600 has a shaft 602 with opposite ends 604 and 606. A handle 610 is at the one end 604 and a threaded portion 612 is at the other end 606 of the shaft 602. To help remove the tool holder 500 from the base 400, the operator can thread the threaded portion 612 of the tool 600 into the threaded bore 550 in the tool holder 500 and threadedly engage the threaded surface 552. Once the threaded connection is secure, the operator can assist in the positioning (e.g., removal or installation) of the tool holder 500 relative to the base 400.

The specific embodiment of the tool holder-base assembly 399 as illustrated in FIGS. 12 through 18 has a number of advantages as will become apparent. One such advantage is the secure connection between the cutting tool holder and the base that minimizes movement of the cutting tool holder in order to maximize the useful life of the cutting tool. Another advantage is the secure connection that makes the connection resistant to vibratory loosening which could likewise lead to premature cutting tool wear and failure.

Figure 20:
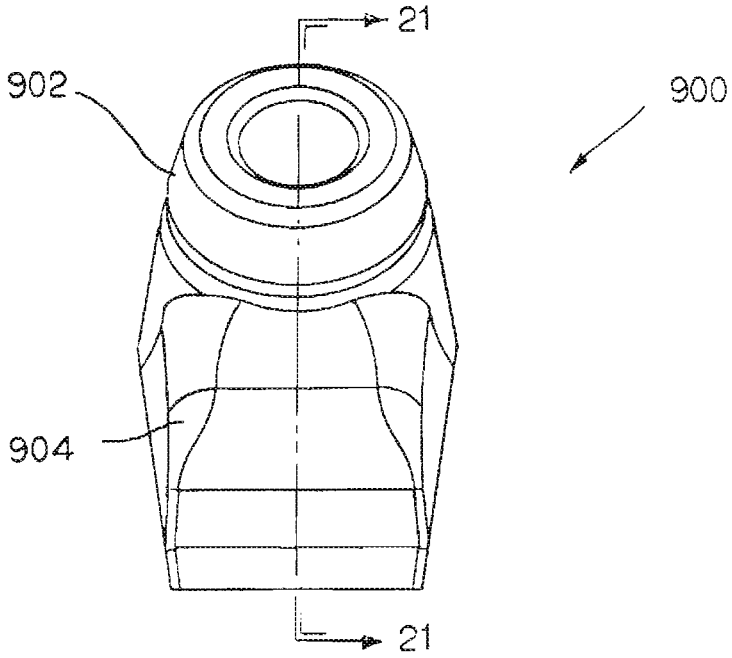
FIG. 20 is a front view of a specific embodiment of a tool holder-base assembly wherein the tool holder is sleeve.
Figure 21:
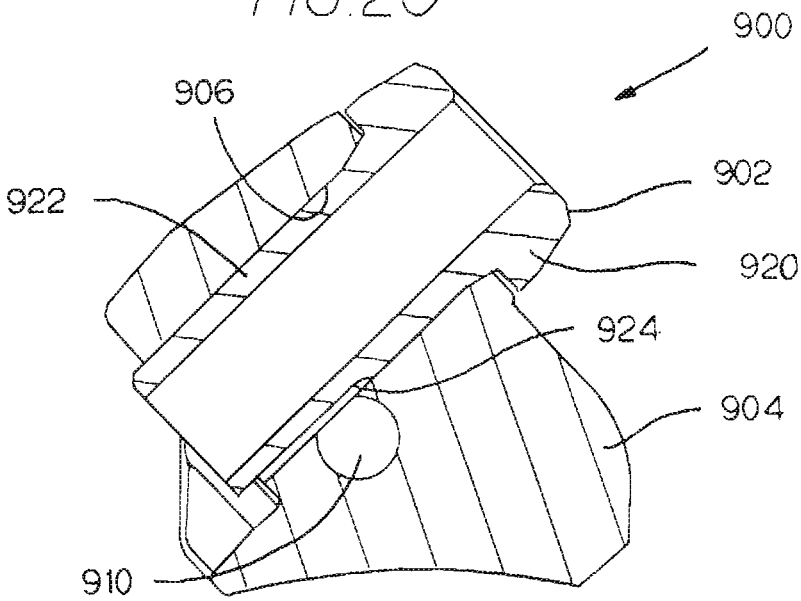
FIG. 21 is a cross-sectional view of the tool holder-base assembly of FIG. 20 taken along section line 21-21 of FIG. 20.

Referring to FIGS. 20-21, there is illustrated a specific embodiment of the tool holder-base assembly generally designated as 900. The tool holder-base assembly 900 comprises a base 904 and a sleeve 902. The base 904 contains a bore 906 that receives the sleeve 902. The base 904 further contains a transverse passage (or bore) 910 that receives a threaded camming pin (not illustrated). The sleeve 902 comprises a head region 920 and a shank region 922. The shank region 922 has a surface 924 at the rearward end thereof.

In operation, the transverse passage 910 receives the threaded camming pin that functions in a manner relative to surface 924 like that of threaded camming pin 670 relative to surface 530.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A cutting bit retention assembly comprising:

a cutting bit holder having a leading end and a trailing end, the bit holder having a head section adjacent to the leading end and a shank section adjacent to the trailing end;

the head section of the cutting bit holder containing a cutting bit bore adapted to receive the cutting bit, and the shank section of the cutting bit holder containing a slot defined by a slot surface;

a support block containing a cutting bit holder bore;

the support block further containing a transverse bore, and the transverse bore opening into the cutting bit holder bore;

the cutting bit holder bore adapted to receive the shank section of the cutting bit holder;

a retention pin received within the transverse bore whereby the retention pin extends into the slot;

the retention pin selectively being in a non-retaining position wherein the retention pin does not engage the slot surface or a retaining position in which the retention pin engages the slot surface to urge the cutting bit holder into the cutting bit holder bore or an ejecting position in which the retention pin engages the slot surface to urge the cutting bit holder out of the cutting bit holder bore , and wherein the retention pin having a camming section extending within the slot, and the camming section having a minimum transverse dimension and a maximum transverse dimension, and the slot having a slot width wherein the minimum transverse dimension is less than the slot width and the maximum transverse dimension is greater than the slot width.

2. The cutting bit retention assembly according to claim 1 wherein the transverse bore comprises a threaded bore and the retention pin comprises a threaded section.

3. The cutting bit retention assembly according to claim 2 wherein the camming section being generally cylindrical, and the camming section containing a notch along the length thereof wherein the camming section having the minimum transverse dimension in the vicinity of the notch.

* * * * *